United States Patent [19]

Gunter

[11] Patent Number: 5,038,438

[45] Date of Patent: Aug. 13, 1991

[54] AUTOMATED YARN MANUFACTURING SYSTEM

[75] Inventor: Josef K. Gunter, Durham, N.C.

[73] Assignee: Industrial Innovators, Inc., Durham, N.C.

[21] Appl. No.: 497,104

[22] Filed: Mar. 21, 1990

[51] Int. Cl.[5] ..... D01G 21/00

[52] U.S. Cl. ..... 19/65 A; 19/200

[58] Field of Search ..... 19/65 A, 97, 98, 99, 19/205, 97.5; 57/400

[56] References Cited

U.S. PATENT DOCUMENTS

| | | | |
|---|---|---|---|
| 2,858,277 | 1/1975 | Brown et al. | 19/99 |
| 3,443,372 | 5/1969 | Eddleston | 19/65 R |
| 3,737,952 | 6/1973 | O'Neal et al. | 19/107 |
| 3,906,588 | 9/1975 | Zafiroglu | 19/97 X |
| 4,057,877 | 11/1977 | Gunter | 19/107 |
| 4,135,275 | 1/1979 | Gunter et al. | 19/107 |
| 4,301,573 | 11/1981 | Gunter et al. | 19/200 |
| 4,539,806 | 9/1985 | Stahlecker | 57/400 |
| 4,563,873 | 1/1986 | Tooka | 57/400 X |
| 4,723,344 | 2/1988 | Lafeld | 19/97.5 X |
| 4,768,262 | 9/1988 | Gunter | 19/258 |
| 4,843,684 | 7/1989 | Pinto et al. | 19/65 A |
| 4,852,217 | 8/1989 | Bernhardt et al. | 19/98 |
| 4,928,353 | 5/1990 | Demuth et al. | 19/65 A |

FOREIGN PATENT DOCUMENTS

| | | | |
|---|---|---|---|
| 0028291 | 5/1981 | European Pat. Off. | 19/98 |
| 0311831 | 4/1989 | European Pat. Off. | 19/65 A |
| 418909 | 2/1967 | Switzerland | 19/65 R |
| 2127446 | 4/1984 | United Kingdom | 19/205 |

*Primary Examiner*—Werner H. Schroeder
*Assistant Examiner*—John J. Calvert
*Attorney, Agent, or Firm*—Richard E. Jenkins

[57] ABSTRACT

An automated fiber processing system for processing of fiber stock in a continuous, uninterrupted process from fiber bales to the formation of spun yarn. The system comprises fiber stock opening means and first air transport means for conveying fiber stock therefrom to feeder blending means for blending the fiber stock; opening and cleaning means for opening and cleaning of the fiber stock; hopper means for receiving the opened and cleaned fiber stock for providing a supply of opened and blended fiber stock; feeding means for transportation of fiber stock from the hopper means to a plurality of carding-type machines which are adapted so that the carded fiber stock will be doffed therefrom in loose fiber form; second air transport means for transporting the doffed fiber stock to a plurality of sliver-making apparatus for forming sliver from the carded fiber stock, wherein the plurality of fiber making apparatus are each a small carding device operatively associated with a corresponding yarn spinning position on a yarn spinning frame or a roving position on a roving frame linked with a ring spinning frame.

35 Claims, 4 Drawing Sheets

AUTOMATED YARN MANUFACTURING SYSTEM

DESCRIPTION

1. Technical

The present invention relates generally to textile fiber processing. More specifically, it relates to the provision of an automated fiber processing system for processing textile fibers from opening through spinning in a completely automated and continuous processing sequence.

2. Background Art

The processing of textile fiber stock from opening through spinning in textile mills is a very old and well developed art. In the past, the processing sequence from bale opening to spinning has been essentially a series of individual processing steps requiring interruption of the fiber processing as the stock is transported from one individual process to another by workers. For example, a traditional interrupted processing sequence could entail the individual processing steps of opening, blending, carding, drawing, roving and spinning to produce a yarn from the bale. Each sequence was labor-intensive and required the handling of fiber stock by workers and the consequential interruption of the processing of the fiber stock.

With the passage of time, many new developments have come about in textile processing of fiber stock from opening through spinning which have simplified and improved the productivity of the traditional processing sequence. For example, the carding and drafting processing steps have been combined into one step by a highly efficient machine called "The Sliver Machine" manufactured by Industrial Innovators, Inc. of Durham, North Carolina. However, even with the combination of certain historical processing steps and improved productivity realized through new and better equipment, no one to date has developed a processing system whereby textile fiber stock can be processed in a continuous, uninterrupted manner from the bale to yarn in an entirely automated system.

DISCLOSURE OF THE INVENTION

In accordance with the present invention, applicant has discovered a new fully automated system for processing textile fiber stock in a continuous, uninterrupted sequence from bale opening to yarn. Although the automated fiber processing system of the invention ca be used in conjunction with either open-end rotor spinning, ring spinning and other spinning systems, it is presently contemplated that a preferred utilization of the automated processing system would be in conjunction with automated open-end rotor spinning equipment presently known to those skilled in the textile art.

Therefore, it is a primary object of the present invention to provide an automated yarn processing system for processing textile fiber stock in a continuous, uninterrupted sequence from bale to yarn.

Another object of the present invention is to provide a fully automated fiber processing system for use in combination with conventional spinning equipment to improve yarn quality.

Still another object of the present invention is to provide a fully automated fiber processing system for use in combination with any of several conventional spinning apparatus.

Still another object of the present invention is to provide a fully automated fiber processing system for use in textile manufacturing which would significantly reduce the manufacturing cost of yarn produced thereby.

It is yet another object of the present invention to provide a fully automated fiber processing system which is particularly adapted for use by textile manufacturers in plants having long continuous production requirements such as sheeting mills, denim mills and terry cloth mills in order to provide high quality yarn at a significantly reduced cost.

Some of the objects of the invention having been stated, other objects will become evident as the description proceeds, when taken in connection with the accompanying drawings.

BEST MODE FOR CARRYING OUT THE INVENTION

Figure 1:
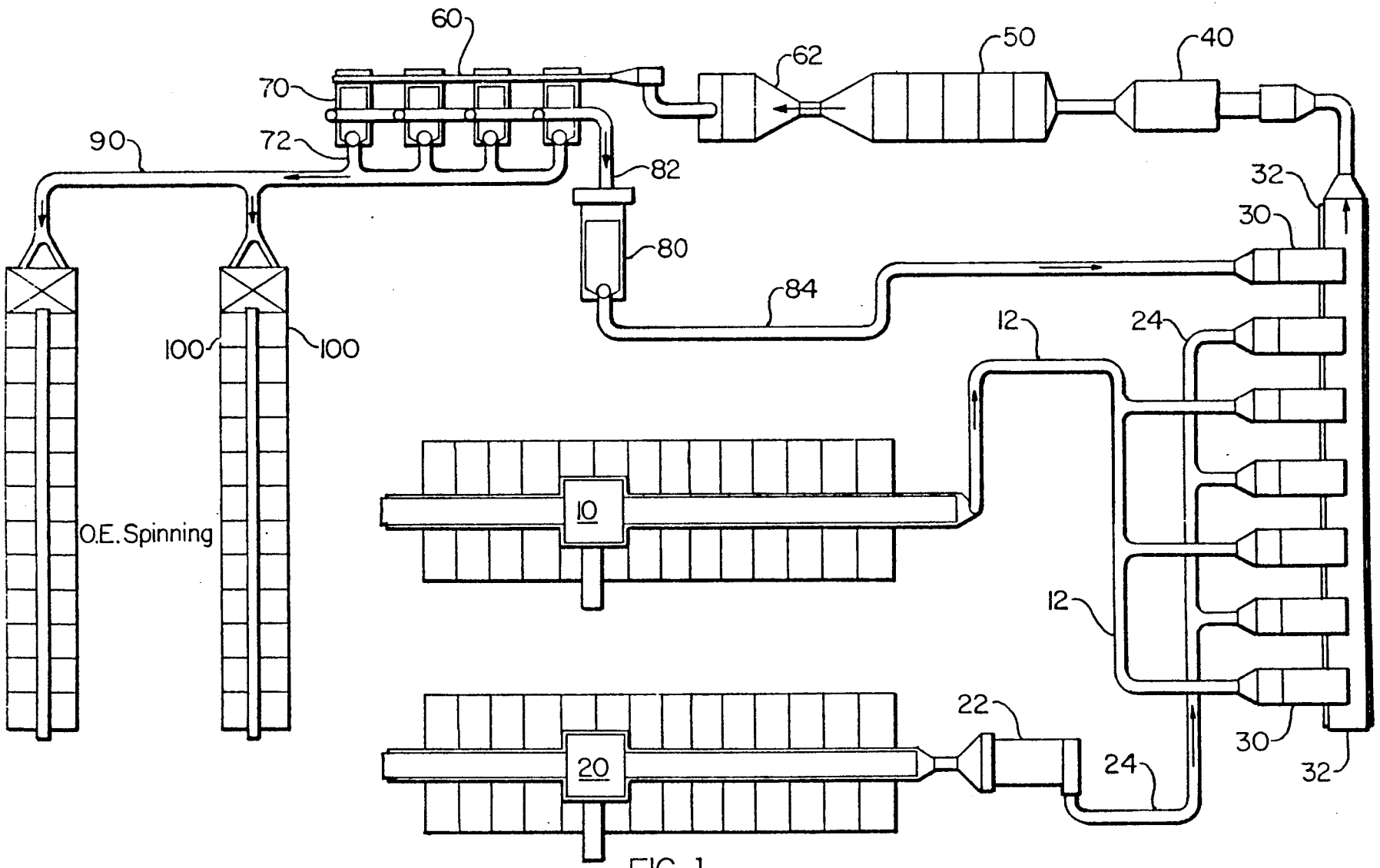
FIG. 1 is a schematic view of the automated fiber processing system utilized in one of the preferred embodiments of the present invention.
Figure 2:
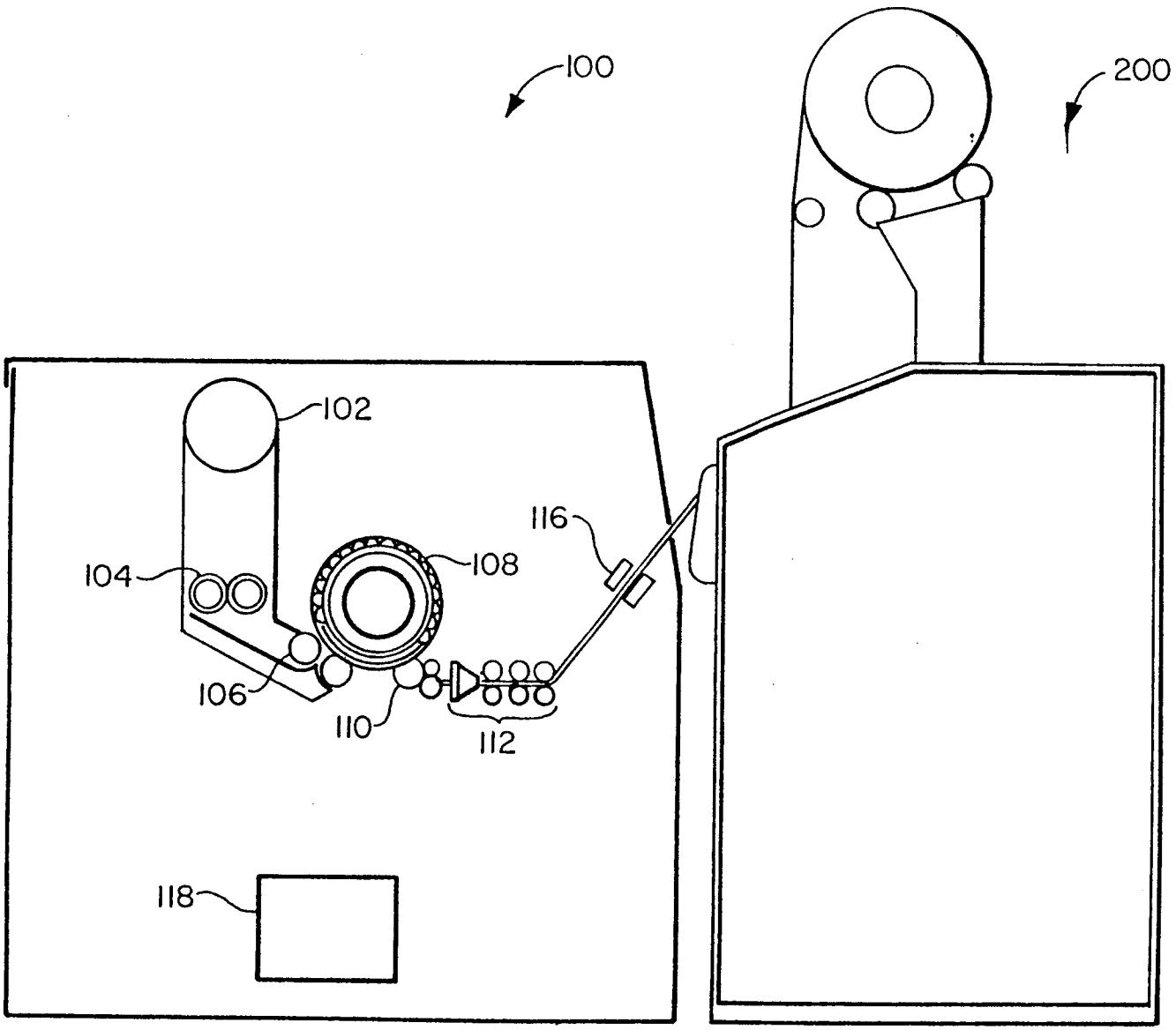
FIG. 2 is a schematic side view of a sliver-making apparatus and associated open-end spinning apparatus as used therein.
Figure 3:
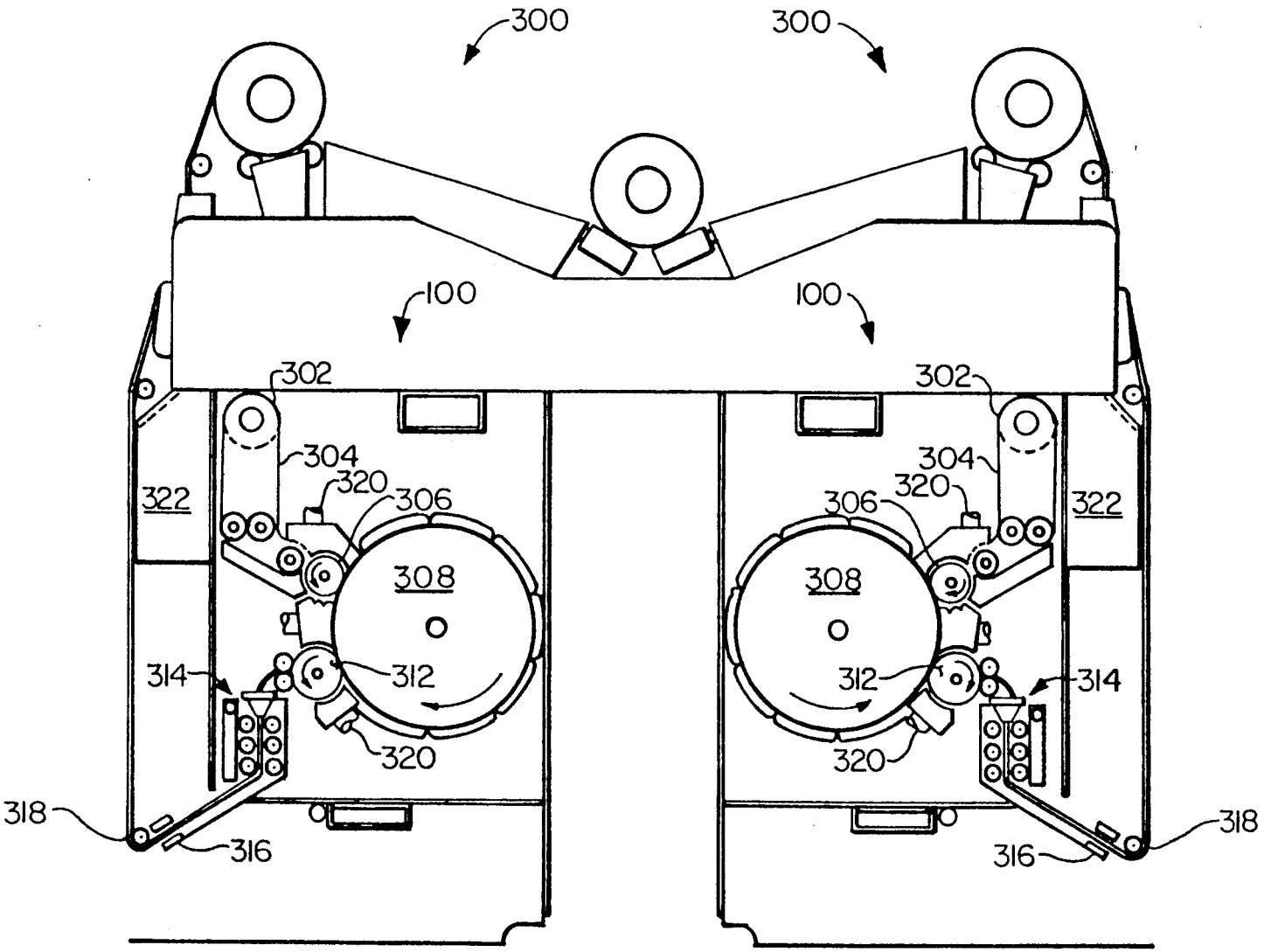
FIG. 3 is a schematic side view of an open-end spinning apparatus incorporating a sliver-making apparatus as an integral part of an open-end spinning machine.

Referring now more specifically to FIGS. 1–3 of the drawings, an exemplary embodiment of the automated fiber processing system of the present invention is shown. Fiber stock, in the form of synthetic fiber bales and cotton fiber bales are provided to synthetic bale opener 10 and cotton bale opener 20. Although many conventional bale opening apparatus can be incorporated into the automated fiber processing system of the invention, applicant presently contemplates that the preferred equipment is readily available from many sources. From bale opener 12, opened fiber stock is transported to step cleaner 22 and then through air conduit 24 to selected blending feeders 30. Conventional blending feeders 30 are also readily available from a number of sources. With reference now to synthetic bale opener 10, it can be seen that the fiber selectively removed from the synthetic fiber stock bales is transported through air conduit 12 to the remaining blending feeders 30. Although a matter of design choice, blending feeders 30 are shown in FIG. 1 as receiving cotton fiber stock and synthetic fiber stock in alternating blending feeders which is an excellent configuration to achieve good blending of a mixture of cotton fiber stock and synthetic fiber stock.

Blending feeders 30 blend the fiber stock and then deposit it on blending belt 32. Blending belt 32 is commercially available from a number of sources. After traversing blending belt 32, the mixture of synthetic fiber stock and cotton fiber stock will be removed from blending belt 32 and placed into an opener and cleaner 40 which is also available from many sources known to those skilled in the fiber processing art. Opener and cleaner 40 further opens the mixture of cotton and synthetic fiber stock which is then transferred to reserve hopper 50 which serves to further blend the fiber stock and provide a consistent feed thereof to the equipment downstream thereof in the automated fiber processing system of the invention. Most suitably, reserve hopper 50 is a multi-cell stack blender such as is manufactured by and available from a number of textile machinery firms.

Next, a card chute feed system 60 is provided for receiving opened fiber stock from reserve hopper 50 and distributing it to modified carding machines 70. Card chute feed system 60 most suitably includes a fine opener 62 which initially receives fiber stock from reserve hopper 50 and further opens it prior to transfer to card chute feed system 60 for distribution to modified carding machines 70. Carding machines 70, most suitably "Extractor Cards" as described in U.S. Pat. No. 4,301,573 and available from Industrial Innovators, Inc. of Durham, North Carolina, are all equipped with an air-doffing plenum 72 and do not require doffers, calendar sections, coilers, can changers or precision weight controls. The automated fiber processing system also obviates the need for draw frames and sliver cans.

When processing cotton stock modified carding machines 70 will most suitably be set to extract about 10–20% of the fibers which will be conveyed to extractor 80 by air conduit 82. Extractor 80, described in U.S. Pat. No. 4,301,573 and available from Industrial Innovators, Inc., will remove cotton micro-dust and short fiber for maximum cleaning, and return good fiber stock through air conduit 84 back to blending feeders 30 for reintroduction into the fiber processing system.

Carding machines 70 each have a production control device (not shown) which is known to those skilled in the art in order to control the rate of fiber stock fed to each carding machine. The process control devices serve to control the production of the carding machines in a manner which is now conventional and was developed by Industrial Innovators, Inc. of Durham, North Carolina and known by the trademark SMART SYSTEM.

Next, the carded fiber stock is transported by air through distribution system 90 to a plurality of sliver-making apparatus 100 (see also FIGS. 2 and 3). Air distribution system 90 is most suitably a high air pressure conduit delivery system that responds, in precise amounts, to individual sliver-making apparatus 100 on demand. The total system production flow is monitored and maintained in a balanced condition based on the production requirements of the spinning apparatus as determined and regulated by tension sensors 116 and 316, respectively, in FIGS. 2 and 3, as will be more fully explained below.

Also, it should be understood and appreciated that for some processing applications a preferred utilization of the automated processing system would be to deliver the fiber directly from fine opener 62 to sliver-making apparatus 100 through air distribution system 90 and thus eliminating the necessity of processing through carding machines 70 and extractor 80. For example, this shortened process could be used for some types of 100% synthetics and certain cotton applications based on end product requirements.

With specific reference now to FIG. 2, it can be seen that sliver-making apparatus 100 is a small carding device which is preferably positioned where the cans are normally located in a conventional open-end rotor spinning apparatus. A sliver-making apparatus 100 can also be positioned to feed each position on a roving frame which is then linked to a ring or similar spinning system to provide a completely automated spinning system. A sliver-making apparatus 100 will be provided for each rotor of an open-end spinning frame (or each position on a roving frame linked to a ring spinning frame) and will be controlled by a microprocessor so as to deliver sliver at the appropriate rate as determined by the particular spinning position. In this fashion, each sliver-making apparatus 100 which will produce precision on-line weight control of sliver will also produce the correct production rate required by the spinning position. It is preferred that sliver-making apparatus 100 be constructed in a unitary frame containing multiple sliver-making apparatus 100 so as to provide the required number thereof to supply all spinning positions on a complete spinning frame.

With specific reference now to both FIGS. 2 and 3, applicant contemplates that a sliver-making apparatus 100 will be provided for each open-end rotor spinning position or each ring spinning position on one or more spinning apparatus which are used in combination with the automated fiber processing system of the invention. Sliver-making apparatus 100 comprises a chute feed 102 which is fluidly connected to air transport and distribution system 90; feed rolls 104 that deliver fiber stock to wire licker-in roll 106 which is most suitably about 3 inches in diameter; a carding cylinder 108 for receiving fiber stock from licker-in roll 106 and which is most suitably about 5–20 inches in diameter (and preferably about 9–12 inches); wire doff roll 110 for doffing fiber from main cylinder 108; a trumpet and drafting roll assembly 112 for forming the fiber stock into a suitable sliver which has been corrected for weight variability and adjusted to the desired grain weight required by a spinning position of a spinning apparatus; tension sensor 116; and microprocessor 118. The technology incorporated by trumpet and drafting roll assembly 112 is disclosed in U.S. Pat. No. 4,768,262 issued to Industrial Innovators, Inc. of Durham, North Carolina. Thus, sliver-making apparatus 100, controlled by a suitable microprocessor, will produce precision on-line weight control of fiber stock sliver required by spinning frame 200 (see FIG. 2). As noted heretofore, a sliver-making apparatus 100 will be provided for each spinning position of one or more spinning frames or roving frames linked to ring spinning frames which are fed by the automated fiber processing system of the invention.

With reference to FIG. 3, as an alternative to the stand-alone positioning of sliver-making apparatus 100 adjacent an open-end spinning or roving frame 200 in the place of conventional sliver cans, the sliver-making apparatus 100 may be integrated into the design of an open-end spinning frame such as shown in FIG. 3. Open-end spinning frame 300 shown in FIG. 3 would have an integral sliver-making apparatus associated with each open-end rotor spinning position which would most suitably comprise a feed line 302 which would be suitably connected to transportation and distribution conduit 90 from carding machines 70; chute feed 304; licker-in roll 306; carding cylinder 308 and carding plates 310; doffer roll 312; trumpet and roller drafting assembly 314; tension sensor 316 and sliver guide 318. Suction is provided by suction plenums 320, and microprocessor control system 322 serves to monitor and control sliver-making apparatus 100 in order to provide the desired sliver weight and quantity to the open-end spinning rotor associated therewith. The integral sliver-making apparatus is substantially identical to the stand-alone apparatus.

It should be appreciated that, most suitably, individual bale openers 10 and 20, blending feeders 30, opener and cleaner 40, reserve hopper 50, card chute feed system 60, carding machines 70, air transportation and distribution system 90 and sliver-making apparatus 100 all utilize microprocessor controls (not shown) which provide for an interactive functional relationship therebetween. A two-way communication link with a central processing unit (CPU) (not shown) is provided between each individual sliver-making apparatus 100 and carding machine 70 in order to provide complete control and management of the fiber stock by the automated fiber processing system of the invention.

In operation, cotton fiber stock is removed from bales at bale opener 20 and processed through step cleaner 22 and then transferred by air conduit 24 to selected blending feeders 30. Simultaneously, synthetic fiber stock is removed from the bales at bale opener 10 and transferred by air conduit 12 to selected blending feeders 30. The fiber stock is blended and placed onto blending belt 32 and from there transferred to opener and cleaner 40. After being opened and cleaned, the fiber stock is next transferred to reserve hopper 50 for further blending and then through fine opener 62 to card chute system 60 to carding machines 70. Carding machines 70 are fluidly connected by air conduit 82 to waste extractor 80 which removes micro-dust and short fibers from the 10–20% of fibers extracted by the carding machines and returns the good fiber through air conduit 84 to blending feeders 30. The carded fiber stock is air-doffed by air-doffing plenums 72 and transported by air transport and distribution system 90 to a plurality of individual sliver-making apparatus 100. Sliver-making apparatus 100 are each essentially small carding units which process the carded fiber stock and form sliver as required for a corresponding open-end spinning frame position or a roving frame position linked with a ring spinning position.

It will be understood that various details of the invention may be changed without departing from the scope of the invention. Furthermore, the foregoing description is for the purpose of illustration only, and not for the purpose of limitation—the invention being defined by the claims.

What is claimed is:

1. A system for automated processing of fiber stock in a continuous process from fiber bales to the formation of spun yarn, said system comprising:

fiber stock opening means for removing selected fiber stock from a source of said fiber stock;

first air transport means for conveying said fiber stock, said first transport means being operatively associated at one end to said fiber stock opening means;

feeder blending means operatively associated with the other end of said first air transport means for blending said fiber stock;

opening and cleaning means operatively associated at one end to said blending means for opening and cleaning of said fiber stock;

hopper means operatively associated with the other end of said opening and cleaning means for producing a supply of said opened and blended fiber stock;

second air transport means for transporting said fiber stock, said second air transport means being operatively associated at one end to said hopper means; and a plurality of sliver-making apparatus for forming sliver from said fiber stock, said plurality of sliver-making apparatus being operatively associated with the other end of said second air transport means and positioned in operative association with at least one corresponding yarn spinning apparatus for providing sliver thereto, wherein each of said plurality of sliver-making apparatus comprises: a feed-roll; a licker-in wire roll; a carding cylinder having a diameter between about 5-20 inches; a doff roll; and a plurality of drafting rollers.

2. A system according to claim 1 wherein said plurality of sliver-making apparatus are positioned adjacent at least one open-end spinning apparatus for providing sliver thereto.

3. A system according to claim 1 wherein said plurality of sliver-making apparatus are positioned adjacent at least one roving frame for providing sliver to said roving frame.

4. A system according to claim 1 wherein said plurality of sliver-making apparatus are affixed to at least one open-end spinning apparatus for providing sliver thereto.

5. A system for automated processing of fiber stock in a continuous process from fiber bales to the formation of spun yarn, said system comprising:

fiber stock opening means for removing selected fiber stock from a source of said fiber stock;

first air transport means for conveying said fiber stock, said first transport means being operatively associated at one end to said fiber stock opening means;

feeder blending means operatively associated with the other end of said first air transport means for blending said fiber stock;

opening and cleaning means operatively associated at one end to said blending means for opening and cleaning of said fiber stock;

hopper means operatively associated with the other end of said opening and cleaning means for producing a supply of said opened and blended fiber stock;

feeding means operatively associated with said hopper means for transportation of said opened fiber stock to a plurality of carding-type machines;

a plurality of carding-type machines operatively associated with said feeding means, said carding-type machines being adapted so that said fiber stock will be doffed therefrom in a loose fiber form;

second air transport means for transporting said doffed fiber stock, said second air transport means being operatively associated at one end to said plurality of carding-type machines; and a plurality of sliver-making apparatus for forming sliver from said fiber stock, said plurality of sliver-making apparatus being operatively associated with the other end of said second air transport means and positioned in operative associated with at least one corresponding spinning apparatus for providing sliver thereto, wherein each of said plurality of sliver-making apparatus comprises: a feed-roll; a licker-in wire roll; a carding cylinder having a diameter between about 5–20 inches; a doff roll; and a plurality of drafting rollers.

6. A system according to claim 5 wherein said fiber stock opening means comprises an automatic bale opener for synthetic fiber stock and an automatic bale opener for cotton fiber stock.

7. A system according to claim 6 said first air transport means comprises a first air transport conduit operatively connected at one end to said synthetic fiber stock bale opener and a second air transport conduit operatively connected at one end to said cotton fiber stock bale opener.

8. A system according to claim 7 wherein a step cleaner is provided at the fiber stock discharging end of said cotton fiber stock bale opener and said second air transport conduit is operatively connected at said one end to said step cleaner.

9. A system according to claim 5 wherein said feeder blending means comprises a plurality of blending hoppers in side-by-side relationship to blend and deposit said blended fiber stock onto a blending conveyor belt.

10. A system according to claim 5 wherein said opening and cleaning means comprises a Rando-type opener.

11. A system according to claim 5 wherein said hopper means comprises a multi-cell stack-blender-type serve hopper.

12. A system according to claim 5 wherein said feeding means comprises a card chute feed system operatively connected to a fine opener which is in turn operatively connected to said hopper means.

13. A system according to claim 5 wherein said plurality of carding-type machines include a fiber waste extractor in fluid communication with said plurality of carding-type machines and adapted to remove fiber waste and to return good fiber stock through a conduit to said feeder blending means.

14. A system according to claim 13 wherein said plurality of carding-type machines each include a process control means for controlling the rate of feeding of said opened fiber stock through said plurality of carding-type machines so as to control the weight of said fiber stock produced thereby.

15. A system according to claim 5 wherein said second air transport means comprises a high air pressure conduit system for transporting said doffed fiber stock to said plurality of sliver-making apparatus, said second air transport means being adapted to deliver selected amounts of fiber stock to individual sliver-making apparatus as needed.

16. A system according to claim 5 wherein said plurality of sliver-making apparatus are positioned adjacent at least one open-end spinning apparatus for providing sliver thereto.

17. A system according to claim 5 wherein said plurality of sliver-making apparatus are positioned adjacent at least one roving frame for providing sliver to said roving frame.

18. A system according to claim 5 wherein said plurality of sliver-making apparatus are affixed to at least one open-end spinning apparatus for providing sliver thereto.

19. A system according to claim 5 including computer means adapted to monitor and adjust the delivery rate of said plurality of carding-type machines so as to correspond to the requirements of said yarn spinning apparatus.

20. A process for automated processing of fiber stock in a continuous process from fiber bales to the formation of spun yarn comprising the steps of:

providing fiber stock to a fiber stock opening means;

removing selected fiber stock by means of said fiber stock opening means;

transporting said opened fiber stock from said fiber stock opening means to feeder blending means;

blending said fiber stock by means of said feeder blending means;

removing said fiber stock from said blending means and introducing said fiber stock into an opening and cleaning means;

opening and cleaning said blended fiber stock by means of said opening and cleaning means and transferring said open fiber stock to hopper means;

transporting said blended fiber stock from said hopper means to a plurality of sliver-making apparatus positioned in operative association with at least one spinning apparatus for providing sliver thereto; and forming sliver by means of said plurality of sliver-making apparatus responsive to the requirements of said at least one spinning apparatus associated therewith, wherein each of said plurality of sliver-making apparatus comprises: a feed-roll; a licker-in roll; a carding cylinder having a diameter between about 5–20 inches; a doff roll; and a plurality of drafting rollers.

21. A process according to claim 20 wherein said plurality of sliver-making apparatus are positioned adjacent at least one open-end spinning apparatus for providing sliver thereto.

22. A process according to claim 20 wherein said plurality of fiber making apparatus are positioned adjacent at least one roving frame for providing sliver to said roving frame.

23. A process according to claim 20 wherein said plurality of sliver-making apparatus are affixed to at least one open-end spinning apparatus for providing sliver thereto.

24. A process for automated processing of fiber stock in a continuous process from fiber bales to the formation of spun yarn comprising the steps of:

providing fiber stock to a fiber stock opening means;

removing selected fiber stock by means of said fiber stock opening means;

transporting said opened fiber stock from said fiber stock opening means to feeder blending means;

blending said fiber stock by means of said feeder blending means;

removing said fiber stock from said blending means and introducing said fiber stock into an opening and cleaning means;

opening and cleaning said blended fiber stock by means of said opening and cleaning means and transferring said open fiber stock to hopper means;

directing said blended fiber stock from said hopper means to a plurality of carding-type machines;

carding said blended fiber stock by means of said plurality of carding-type machines and doffing said fiber stock from said plurality of carding-type machines in loose fiber form;

transporting said doffed carded fiber stock from said plurality of carding machines to a plurality of sliver-making apparatus positioned in operative association with at least one spinning apparatus for providing sliver thereto; and forming sliver by means of said plurality of sliver-making apparatus responsive to the requirements of said at least one spinning apparatus associated therewith, wherein each of said plurality of sliver-making apparatus comprises: a feed-roll; a licker-in roll; a carding cylinder having a diameter between about 5–20 inches; a doff roll; and a plurality of drafting rollers.

25. A process according to claim 24 including the additional step of providing further opening of said fiber stock between said hopper means and said carding-type machines.

26. A process according to claim 24 including the additional step of providing a fiber waste extractor in fluid communication with said plurality of carding-type machines for removing fiber waste and returning good fiber stock to said feeder blending means.

27. A process according to claim 24 wherein said plurality of carding-type machines each include process control means for controlling the rate of feeding of said opened fiber stock through said plurality of carding-type machines so as to control the weight of said fiber stock produced by said carding-type machines.

28. A process according to claim 24 wherein said plurality of sliver-making apparatus are positioned adjacent at least one open-end spinning apparatus for providing sliver thereto.

29. A process according to claim 24 wherein said plurality of fiber making apparatus are positioned adjacent at least one roving frame spinning apparatus for providing sliver to said roving frame.

30. A process according to claim 24 wherein said plurality of sliver-making apparatus are affixed to at least one open-end spinning apparatus for providing sliver thereto.

31. A process according to claim 24 including computer means adapted to monitor and adjust the delivery rate of said plurality of carding-type machines so as to correspond to the requirements of said yarn spinning apparatus.

32. A system for automated processing of fiber stock in a continuous process from fiber bales to the formation of spun yarn, said system comprising:

fiber stock opening means for removing selected fiber stock from a source of said fiber stock;

first air transport means for conveying said fiber stock, said first transport means being operatively associated at one end to said fiber stock opening means;

feeder blending means operatively associated with the other end of said first air transport means for blending said fiber stock;

opening and cleaning means operatively associated at one end to said blending means for opening and cleaning of said fiber stock;

hopper means operatively associated with the other end of said opening and cleaning means for producing a supply of said opened and blended fiber stock;

second air transport means for transporting said fiber stock, said second air transport means being operatively associated at one end to said hopper means; and a plurality of sliver-making apparatus for forming sliver from said fiber stock, said plurality of sliver-making apparatus being operatively associated with the other end of said second air transport means and adapted to be positioned in operative association with a corresponding yarn spinning apparatus and to provide sliver directly thereto.

33. A system for automated process of fiber stock in a continuous process from fiber bales to the formation of spun yarn, said system comprising:

fiber stock opening means for removing selected fiber stock from a source of said fiber stock;

first air transport means for conveying said fiber stock, said first transport means being operatively associated at one end to said fiber stock opening means;

feeder blending means operatively associated with the other end of said first air transport means for blending said fiber stock;

opening and cleaning means operatively associated at one end to said blending means for opening and cleaning of said fiber stock;

hopper means operatively associated with the other end of said opening and cleaning means for producing a supply of said opened and blended fiber stock;

feeding means operatively associated with said hopper means for transportation of said opened fiber stock to a plurality of carding-type machines;

a plurality of carding-type machines operatively associated with said feeding means, said carding-type machines being adapted so that said fiber stock will be doffed therefrom in a loose fiber form;

second air transport means for transporting said doffed fiber stock, said second air transport means being operatively associated at one end to said plurality of carding-type machines; and a plurality of sliver-making apparatus for forming sliver from said fiber stock, said plurality of sliver-making apparatus being operatively associated with the other end of said second air transport means and adapted to be positioned in operative association with a corresponding spinning apparatus and to provide sliver directly thereto.

34. A process for automated processing of fiber stock in a continuous process from fiber bales to the formation of spun yarn comprising the steps of:

providing fiber stock to a fiber stock opening means;

removing selected fiber stock by means of said fiber stock opening means;

transporting said opened fiber stock from said fiber stock opening means to feeder blending means;

blending said fiber stock by means of said feeder blending means;

removing said fiber stock from said blending means and introducing said fiber stock into an opening and cleaning means;

opening and cleaning said blended fiber stock by means of said opening and cleaning means and transferring said open fiber stock to hopper means;

transporting said blended fiber stock from said hopper means to a plurality of sliver-making apparatus positioned in operative association with at least one spinning apparatus so as to provide sliver directly thereto;

forming sliver by means of said plurality of sliver-making apparatus responsive to the requirements of said at least one spinning apparatus associated therewith and feeding said sliver directly to said at least one spinning apparatus.

35. A process for automated processing of fiber stock in a continuous process from fiber bales to the formation of spun yarn comprising the steps of:

providing fiber stock to a fiber stock opening means;

removing selected fiber stock by means of said fiber stock opening means;

transporting said opened fiber stock from said fiber stock opening means to feeder blending means;

blending said fiber stock by means of said feeder blending means;

removing said fiber stock from said blending means and introducing said fiber stock into an opening and cleaning means;

opening and cleaning said blended fiber stock by means of said opening and cleaning means and transferring said open fiber stock to hopper means;

directly said blended fiber stock from said hopper means to a plurality of carding-type machines;

carding said blended fiber stock by means of said plurality of carding-type machines and doffing said fiber stock from said plurality of carding-type machines in loose fiber form;

transporting said doffed carded fiber stock from said plurality of carding machines to a plurality of sliver-making apparatus positioned in operative association with at least one spinning apparatus so as to provide sliver directly thereto; and forming sliver by means of said plurality of sliver-making apparatus responsive to the requirements of said at least one spinning apparatus associated therewith and feeding said sliver directly to said at least one spinning apparatus.

* * * * *

UNITED STATES PATENT AND TRADEMARK OFFICE

CERTIFICATE OF CORRECTION

PATENT NO. : 5,038,438

DATED : August 13, 1991

INVENTOR(S) : Josef K. Gunter

It is certified that error appears in the above-identified patent and that said Letters Patent is hereby corrected as shown below:

Column 2, line 22, after "therein;" delete "and".

Figure 4:
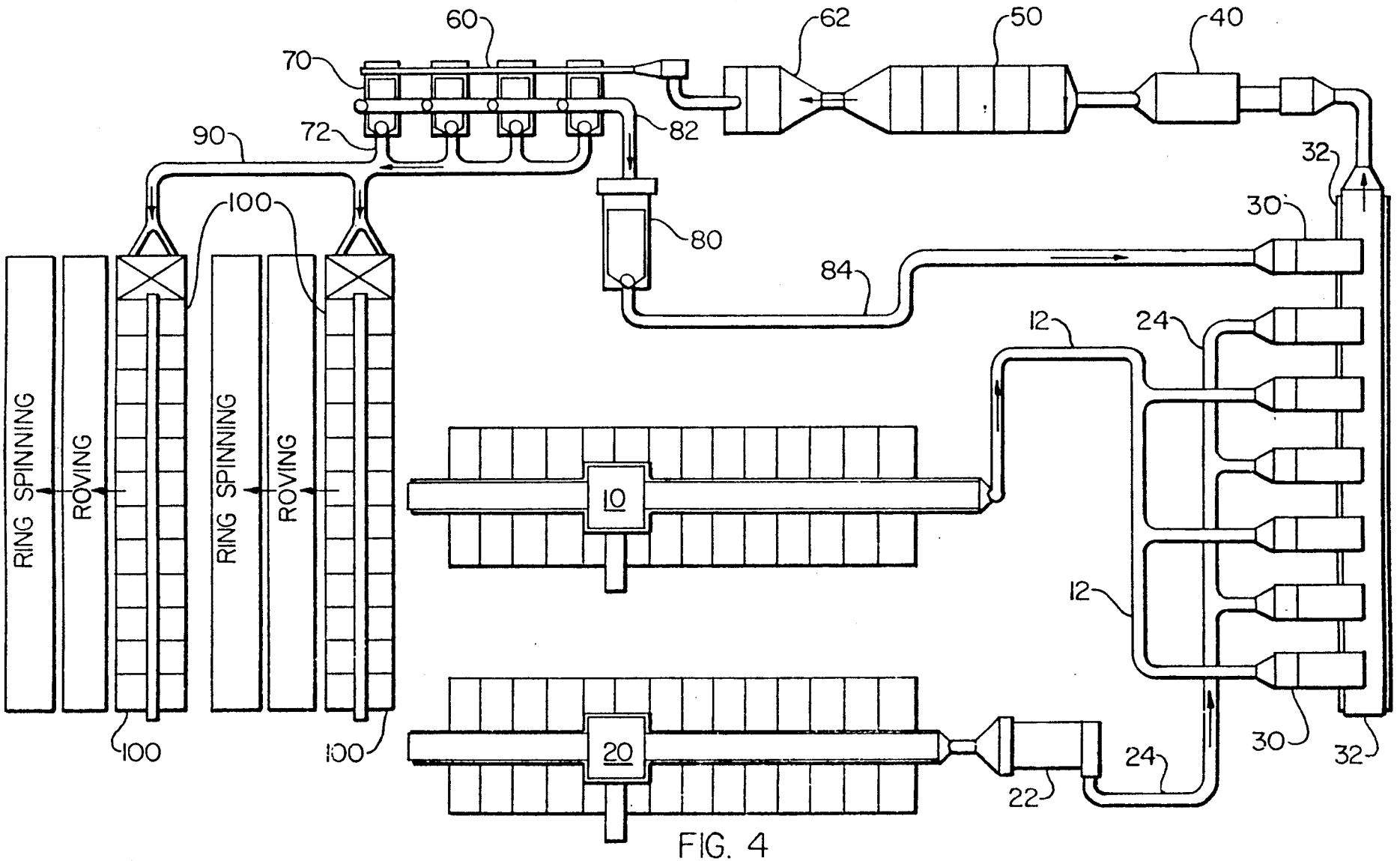

Column 2, line 25, after "machine" delete "." and insert --; and Fig. 4 is a schematic view of the automated fiber processing system utilized in another of the preferred embodiments of the present invention.--

Column 4, line 15, after "position" and before "or", insert --(see Figure 1)--; and after "position" and before "on", insert --(see Figure 4)--.

Column 4, line 40, after "frames" insert --(see Figure 1)--.

Column 4, line 41, after "frames" insert --(see Figure 4)--.

Signed and Sealed this

Fifteenth Day of June, 1993

*Attest:*

Michael K. Kirk

MICHAEL K. KIRK

*Attesting Officer*

*Acting Commissioner of Patents and Trademarks*